United States Patent [19]

Milone

[11] Patent Number: 4,956,271

[45] Date of Patent: Sep. 11, 1990

[54] MATERIAL TREATMENT

[75] Inventor: Philip G. Milone, Burlington, Mass.

[73] Assignee: Wolverine Corporation, Merrimac, Mass.

[21] Appl. No.: 375,814

[22] Filed: Jul. 5, 1989

[51] Int. Cl.[5] ..... F27B 9/28

[52] U.S. Cl. ..... 432/59; 432/8; 432/72; 34/57 R

[58] Field of Search ..... 432/59, 8, 253, 258, 432/259, 72; 34/57 R

[56] References Cited

U.S. PATENT DOCUMENTS

| | | | |
|---|---|---|---|
| 3,262,217 | 7/1966 | Brown . | |
| 3,372,489 | 3/1968 | Brown . | |
| 4,116,620 | 9/1978 | Stible | 432/59 |
| 4,201,499 | 5/1980 | Buske . | |
| 4,322,447 | 3/1982 | Hubbard . | |
| 4,373,702 | 2/1983 | Jayaraman et al. | 432/8 |
| 4,493,640 | 1/1985 | Hanson | 432/59 |
| 4,529,379 | 7/1985 | DiCastri | 432/59 |
| 4,790,749 | 12/1988 | Mauro | 432/8 |
| 4,802,843 | 2/1989 | Chilva | 432/8 |

*Primary Examiner*—Henry C. Yuen

*Attorney, Agent, or Firm*—Fish & Richardson

[57] ABSTRACT

A multimode thermal treatment system includes a series of particle treatment zones. Perforate conveyer structure for supporting the particulate product to be thermally treated is disposed for movement through the series of treatment zones. Each treatment zone includes first (upper) distribution plenum structure disposed above the treatment zone and an array of nozzle tubes extending downwardly from the upper distribution plenum into the treatment zone to flow conditioned gas with substantial velocity into the treatment zone for thermal treatment of particulate material being transported by the conveyer structure through the treatment zone; and a second (lower) distribution plenum disposed below the treatment zone for pressurizing the region below the treatment zone and flowing conditioned gas upward through the conveyer structure and the particulate material on the conveyer. The upper and lower distribution plenums are connected to conditioning gas circuit structure, and distribution of gas through the upper and lower distribution plenums to the treatment zone and discharge therefrom is controlled selectively to provide different modes of particulate product treatment.

25 Claims, 6 Drawing Sheets

MATERIAL TREATMENT

This invention relates to material treatment systems, and more particularly to systems for treating particulate products by fluidizing interaction with a gaseous medium brought into heat exchange or other treating relation therewith as the particles to be treated are conveyed through a treatment zone.

Particulate materials differ widely in physical characteristics and moisture content, and particulate materials may require several different thermal treatment steps. The nature and degree of fluidization of particular products is determined in large measure by physical characteristics of the particles to be dried, toasted, etc. (i.e. flowability, moisture content, friability). Such materials may be treated, for example, by flowing gas through a permeable layer of particles in a downward flow direction—a method commonly used in predrying very moist, precooked grain products such as whole grain rice and corn-based materials; by flowing gas through a bed of particulate product in an upward flow direction to gently fluidize or aerate the product above the support conveyer—a method used for more intense drying of lower moisture flowable particles; or by fluidizing the particles with high velocity gas flows directed downwardly against the particles as they are conveyed through a treatment zone by a solid belt conveyer—a method often used in finish drying and toasting of cereals and snacks, puffing grain products, roasting nuts and beans, and cooling of dried particles. Frequently, a processing sequence desirably involves two or more different types of product treatment, for example a predrying, toasting and cooling sequence.

In accordance with one aspect of the invention, there is provided a multimode thermal treatment system that includes a series of particle treatment zones. Perforate conveyer structure for supporting the particulate product to be thermally treated is disposed for movement through the series of treatment zones. Each treatment zone includes first (upper) distribution plenum structure disposed above the treatment zone and an array of nozzle tubes extending from the upper distribution plenum into the treatment zone to flow conditioned gas with substantial velocity into the treatment zone for thermal treatment of particulate material being transported by the conveyer structure through the treatment zone; and a second (lower) distribution plenum disposed below the treatment zone for pressurizing the region below the treatment zone and flowing conditioned gas upward through the conveyer structure and the particulate material on the conveyer. The upper and lower distribution plenums are connected to conditioning gas circuit structure, and control structures in the circuit structure control distribution of gas through the upper and lower distribution plenums to the treatment zone and discharge therefrom to selectively provide different modes of particulate product treatment. In a preferred embodiment, the system includes a series of thermally insulated housings, each of which includes two treatment zones.

In accordance with another aspect of the invention, there is provided a material treatment system that includes thermally insulated housing structure, structure in the housing structure that defines a treatment zone for particulate material, perforate conveyer structure for supporting particulate material to be thermally treated that defines a lower boundary of the treatment zone, means for exhausting gas from the treatment zone, sidewall structure at either side of the treatment zone including elongated orifice defining structure adjacent the conveyer structure, and containment plenum structure coupled to the orifice defining sidewall structures for flowing gas through the orifice defining structure into the treatment zone for containing particulate material within the treatment zone. Structure defining a first distribution plenum is disposed above the treatment zone, and an array of nozzle tubes extends downwardly from the first distribution plenum and terminates in orifices spaced from the conveyor structure for directing gas passing through the nozzle tubes in an array of gas jets downwardly towards the conveyer structure, and structure defining a second distribution plenum is disposed beneath the conveyer below the treatment zone. Conduit means that flows conditioned gas to the distribution and containment plenum structures include valve means for controlling the conditioning gas flows to the plenum structures such that the system has a first mode of operation in which conditioning gas is flowed downwardly from the upper distribution plenum through the treatment zone and the perforate conveyer structure into the second distribution plenum for exhaust therefrom; a second mode of operation in which conditioning gas is flowed from the second distribution plenum upwardly through the perforate conveyer structure into the treatment zone and exhaust therefrom; and a third treatment mode in which conditioning gas is flowed into the second distribution plenum to maintain that plenum at a positive pressure concurrently with flow of gas from the first distribution plenum through the array of nozzle tubes in a multiplicity of downwardly directed jets with substantial velocity to fluidize and thermally process particulate material on the conveyer structure in the treatment zone with exhaust of gas from the treatment zone in an upward direction away from the conveyer structure.

In a particular thermal treatment system for processing cereal grain products, the perforate conveyor structure includes a wire mesh transport belt, and the particle treatment zone includes on either side a vertical wall with inclined discharge orifice structure at the base of the vertical wall that extends along the length of the treatment zone and cooperates with the upper surface of the transport belt and through which air is flowed from chamber containment chamber structure. The particle treatment zone includes discharge port structure that is connected via control valve structure to exhaust conduit structure. Tube sheet structure is seated at the upper ends of the vertical walls and defines the upper boundary of the treatment zone, the tube sheet structure carrying an array of said nozzle tubes that are spaced less than twenty-five centimeters on center and extend over the length and width of treatment zone. The lower end of each tube is spaced about ten centimeters from the transport belt, and the transport belt has apertures in the range of 0.1–1.0 centimeter in dimension. Optional baffle plate structure in the particle treatment zone is movable between a raised (inoperative) position and a lower velocity reducing position between the lower ends of the nozzle tubes and the conveyor structure. Air blast structure and vacuum structure are coupled to the second distribution plenum for removing debris from the conveyor and from the second distribution plenum. Associated with the system are burner means for heating conditioning gas, blower means for circulating conditioning gas, cyclone separator structure that is coupled in feedback loop relation between the treatment zone and the blower means and a cooler circuit that is coupled between the cyclone separator and the blower.

The system provides versatile apparatus of the continuous processing type with capability of a coordinated, efficient sequence of different types of particulate material treatment in a controlled environment.

Other features and advantages of the invention will be seen as the following description of a particular embodiment progresses, in conjunction with the drawings, in which.

DESCRIPTION OF PARTICULAR EMBODIMENT

Figure 1:
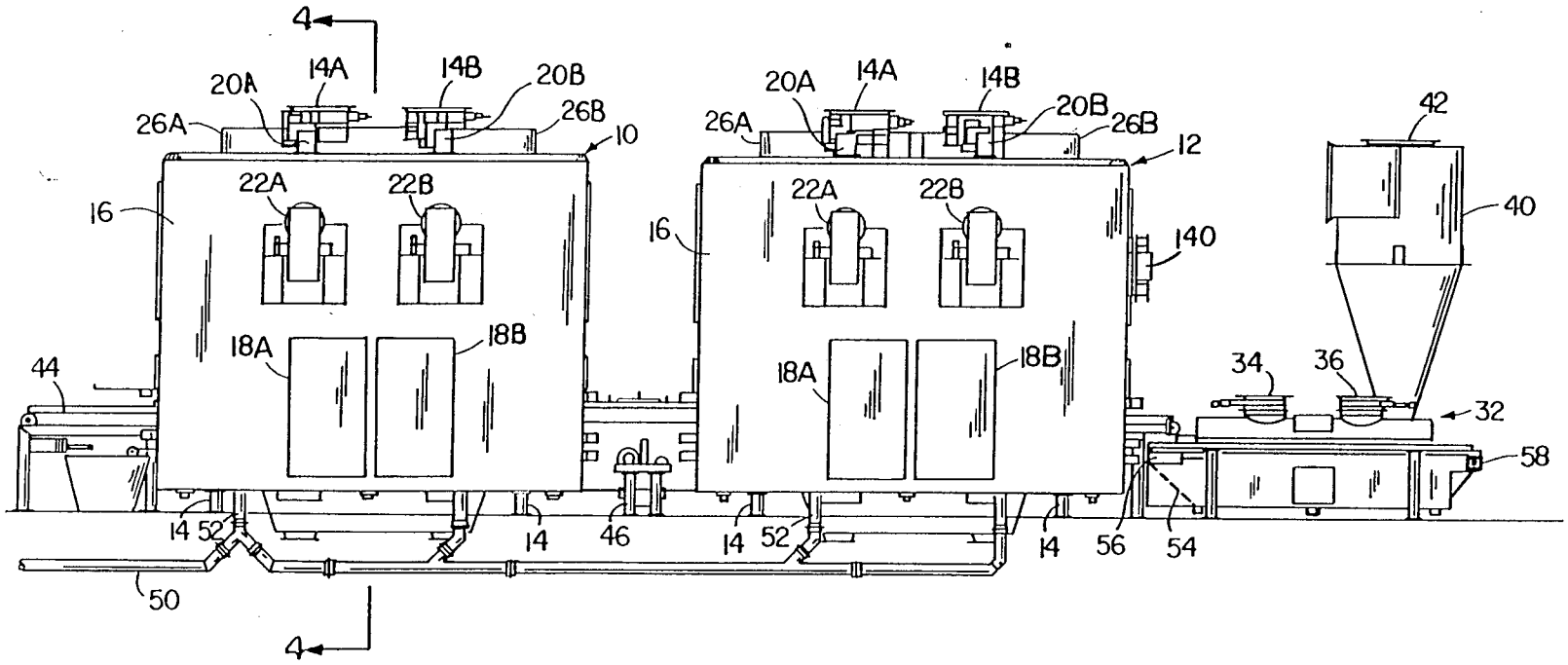
FIG. 1 is a side elevation view of a treatment system in accordance with the invention.
Figure 2:
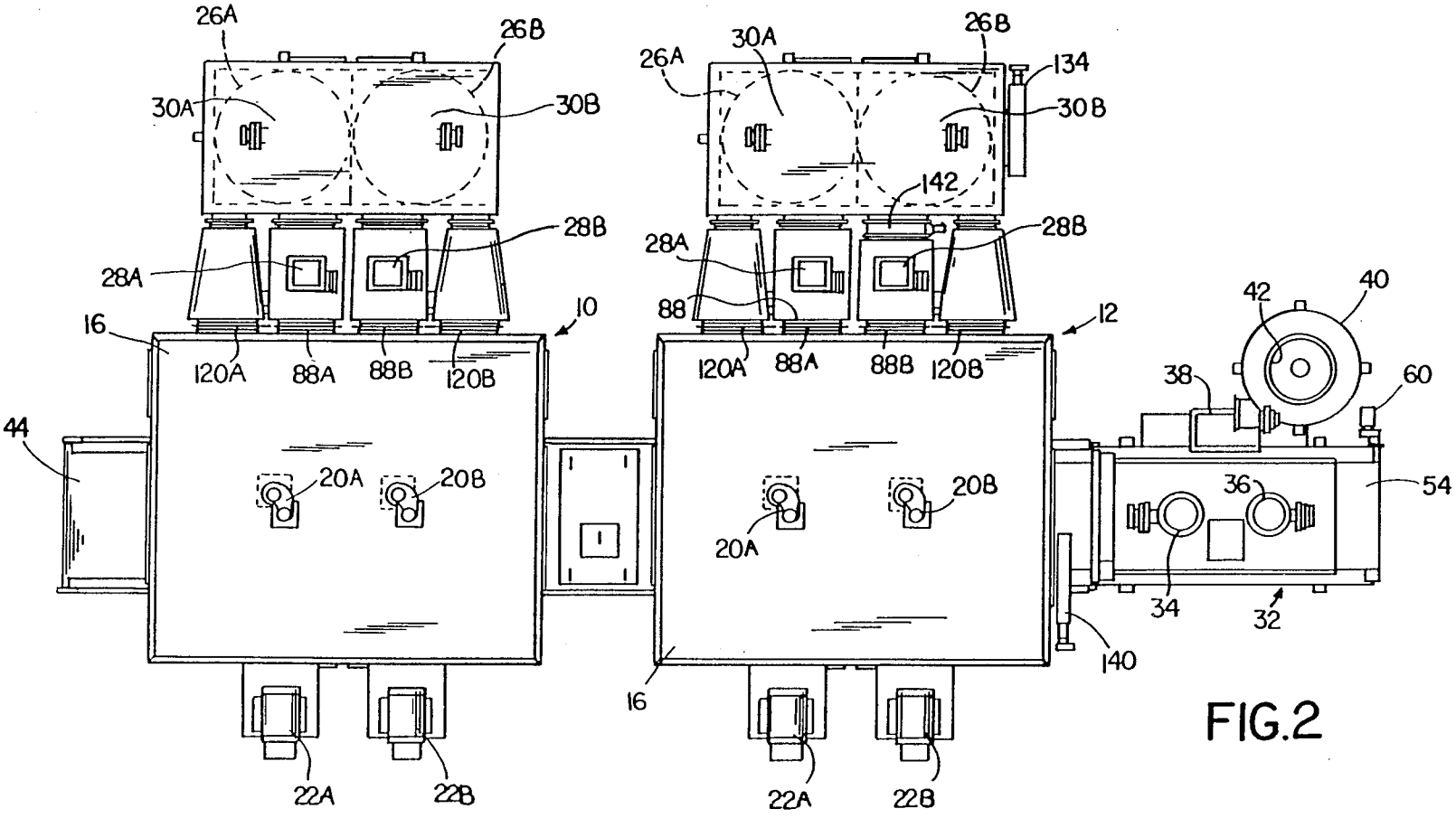
FIG. 2 is a top plan view of the treatment system shown in FIG. 1.
Figure 3:
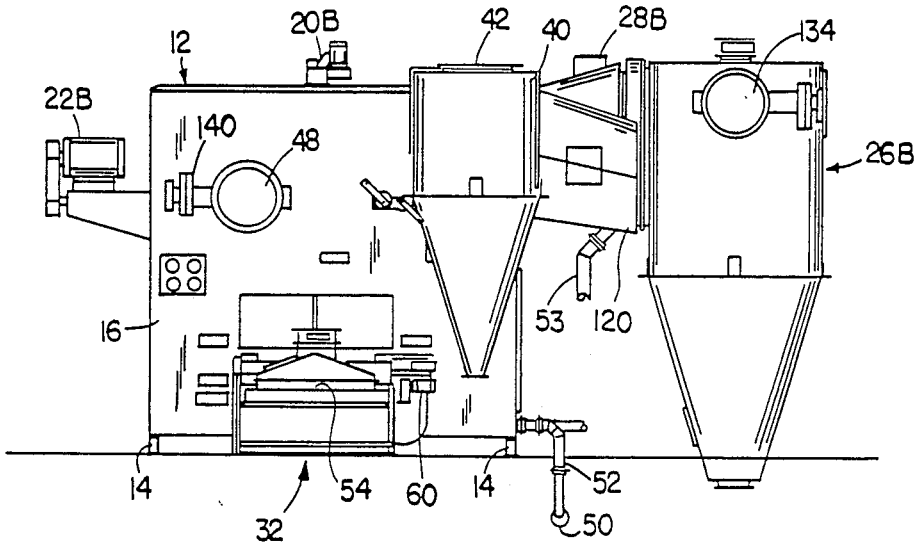
FIG. 3 is an end view of the treatment shown in FIG. 1.

Shown in FIGS. 1–3 is a processing system in accordance with the invention that includes processing units 10 and 12, each of which has two zones A and B, and cooler unit 32. Each processing unit 10, 12 is mounted on support members 14 and has a thermally insulated housing 16 that is about 4.6 meters in length, about 3.7 meters in width and about 4 meters in height and has access panels 18. Associated with each zone of each processing unit is a burner unit 20, a forty horsepower drive motor 22 for driving circulating fan 24, and a cyclone separator 26. Each zone 10A, 10B, 12A, 12B includes makeup air inlet port 28 and cyclone exhaust port 30. Unit 12 includes 0.6 meter diameter cooler inlet 48 that is controlled by damper 140 and the inlet from cyclone 26B is controlled by damper 142. Cooler unit 32 is coupled to the second treatment unit 12 and has air inlets 34, 36, exhaust port 38 and cyclone collector 40 with exhaust port 42.

Wire belt 44 (about one hundred twenty centimeters in width) is of woven balanced weave with openings of about 0.7 centimeter dimension. Conveyor belt 44 extends through processing units 10, 12 and returns beneath those units, and is driven by drive 46. A vacuum cleaning system includes conduits 50 that have couplings 52 to each zone of each processing unit 10, 12 and couplings 53 to cyclone 26. A separate conveyor 54 for cooler unit 32 is trained over rollers 56, 58 at opposite ends of the cooler unit and driven by drive motor 60.

Figure 4:
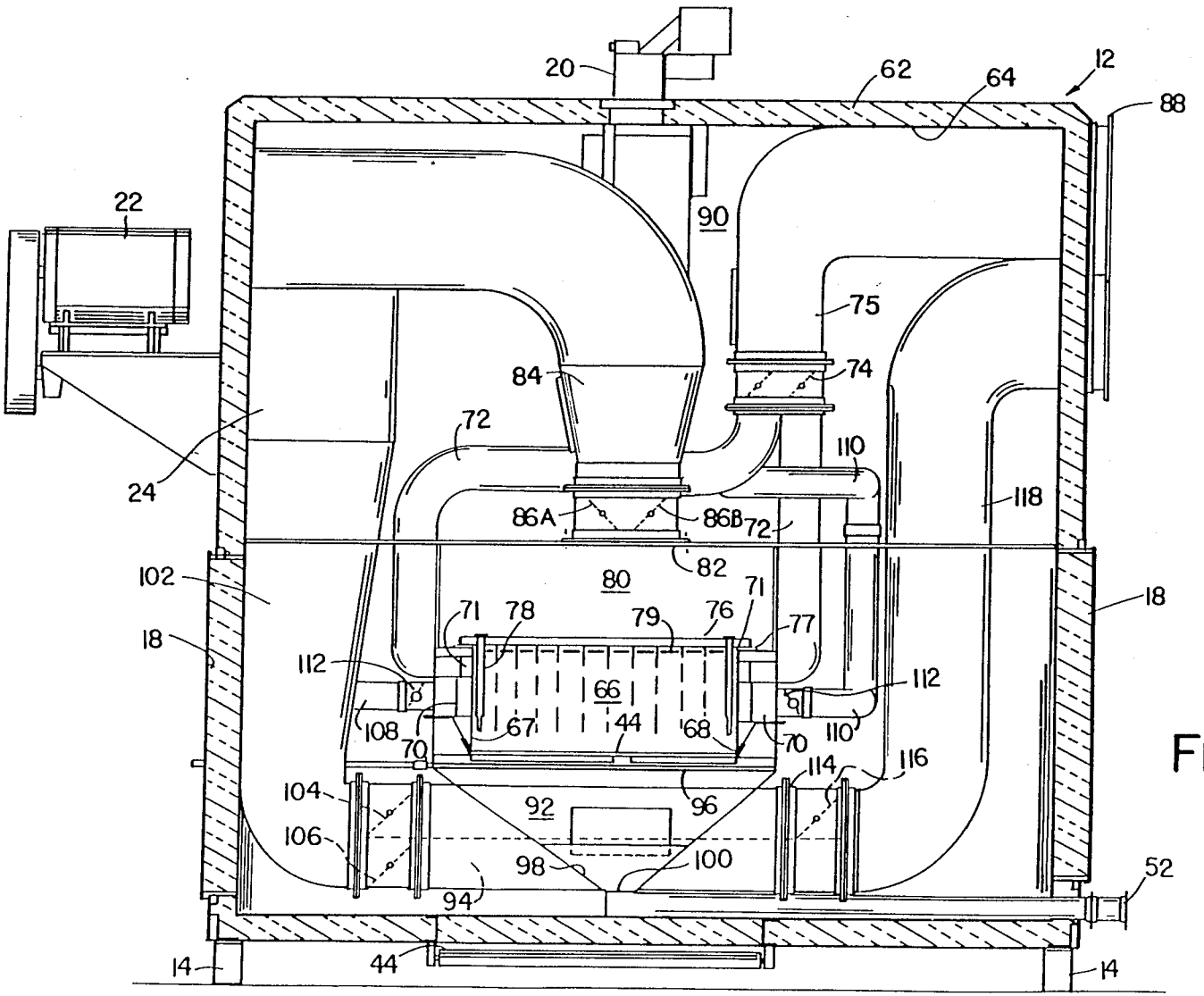
FIG. 4 is a cross sectional view taken along the line 4—4 of FIG. 1.

Further details of a zone of a processing unit may be seen with reference to FIG. 4. As indicated in that Figure, thermal insulation 62 is disposed on the walls of housing 16 and the inner surface of insulation 62 is covered with stainless steel sheeting 64. Disposed within housing 6 is treatment chamber 66 for the particulate material to be treated. Chamber 66 has a height of about forty-five centimeters and a width of about one hundred twenty-six centimeters and extends the length of the treatment zone. Chamber 66 is bounded on its lower surface by wire mesh transport belt 44, and on either side by a vertical wall 67 with inclined discharge orifice structure 68 at the base of wall 67 that extends along the length of the treatment chamber and cooperates with the upper surface of transport belt 44. Air is flowed from containment chamber structure 70 through orifices 68. In the upper portion of each sidewall 67 is exhaust port structure 71 that is connected via exhaust conduits 72 and control dampers 74 to exhaust passage 75. Tube sheet structure 76 is seated on ledges 77 at the upper end of each vertical sidewall 67 and defines the upper boundary of treatment chamber 66. Tube sheet structure 76 carries an array of elongated tubes 78 that are spaced about ten centimeters on center and extend over the length and width of treatment zone 66. Each tube 78 has a length of about thirty five centimeters and is swaged at its lower end to a reduced diameter of about two centimeters with its lower end spaced about ten centimeters from conveyor 44 Disposed in chamber 66 is optional baffle plate 79 that is movable between a raised (inoperative) position (FIG. 6) and a lower (FIG. 5) velocity reducing position beneath and spaced from the lower ends of tubes 78.

Tube sheet structure 76 forms a portion of the lower wall of distribution plenum 80 that has a height of about 0.5 meter and a width of about 1.6 meters. A rectangular inlet port 82 (about 0.4 by 0.9 meters in dimension) in the upper wall of distribution plenum 80 is supplied through tubular conduit 84 from blower 24 that is driven by motor 22. Damper structures 86A and 86B control the quantity of air flowed into distribution plenum 80. Burner 20 is coupled to the reheat chamber 90 and heats air flowed from inlet 88 through chamber 90 to blower 24.

A lower distribution plenum 92 is disposed beneath conveyor belt 44. Plenum 92 has a height of about 0.6 meter and a width of about 1.6 meters. Extending through the bottom portion of distribution plenum 92 is bypass conduit 94, and also disposed in plenum 92 is air blast manifold 96 and conical collecting structure 98 that extends to port 100 in the base of plenum 92 that is connected to vacuum cleaning conduit 52. Air from blower 24 is supplied through main conduit 102 to distribution plenum 92 and bypass conduit 94 as controlled by dampers 104, 106. Conduits 108 and 110 from supply conduits 84 and 102 are connected to containment chamber structures 70 and include dampers 112 to control of flow into those containment chambers 70. Plenum 92 has an exhaust port 114 on the side opposite the inlet port that is controlled by damper 116 and that port is connected by conduit 118 to exhaust port structure 120 to which conduits 72 are also connected for flow of exhaust air to cyclone collector 26.

Figure 5:
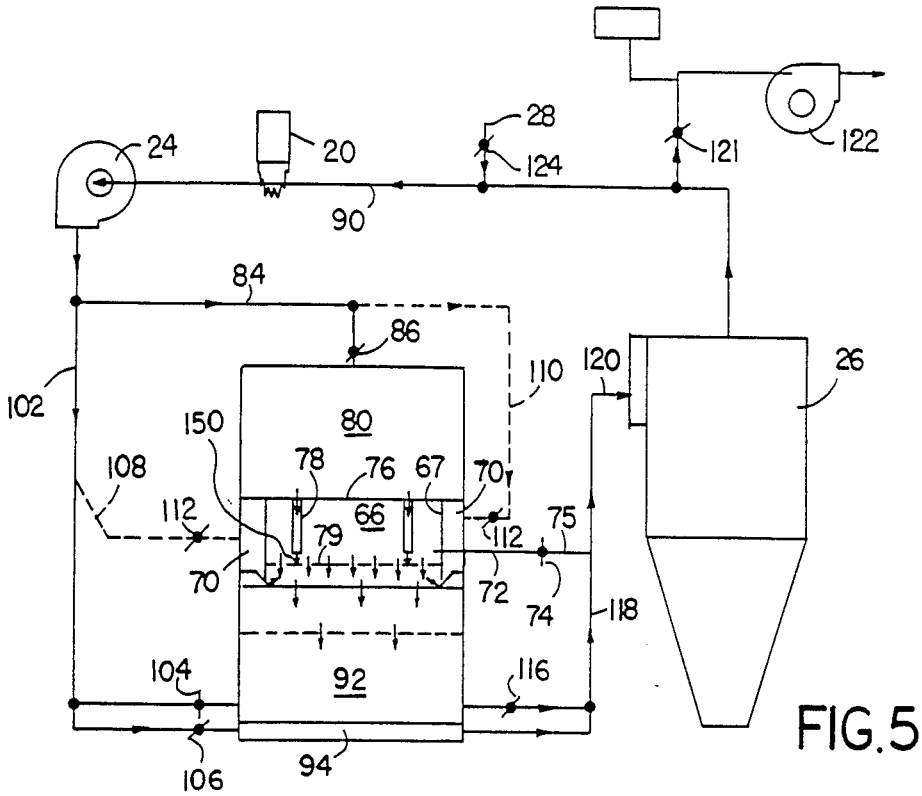
FIGS. 5–8 are diagrammatic views of modes of operation of a treatment zone of the system shown in FIG. 1.
Figure 6:
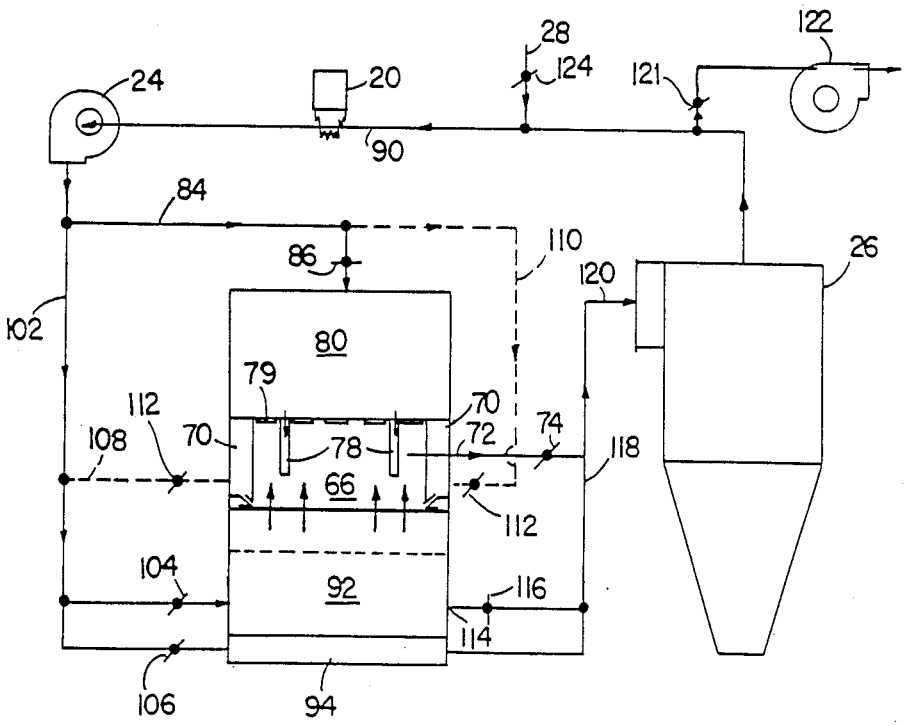
Figure 7:
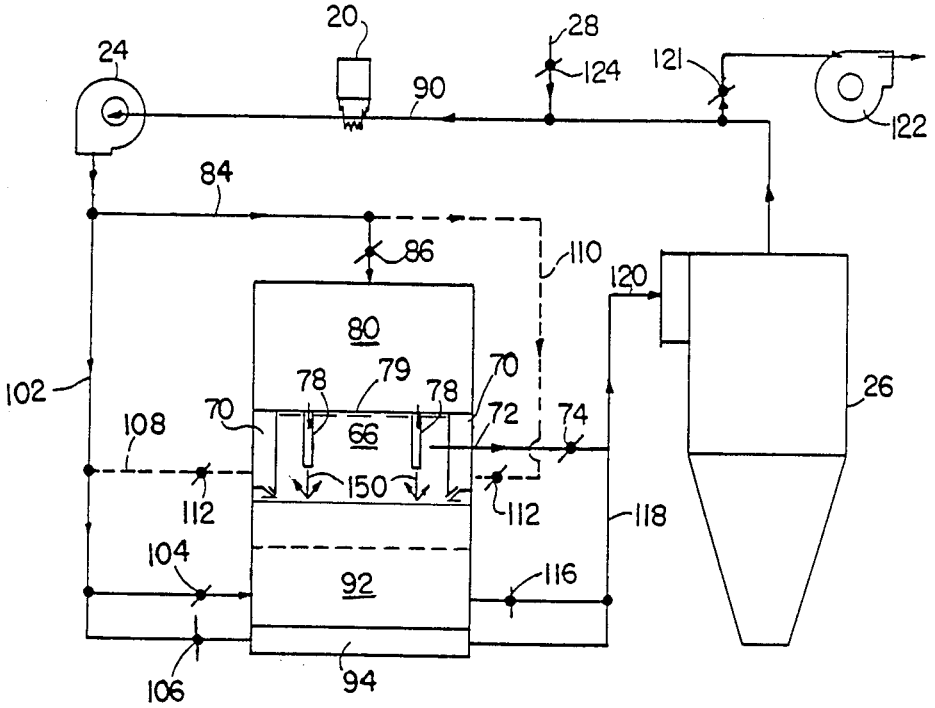
Figure 8:
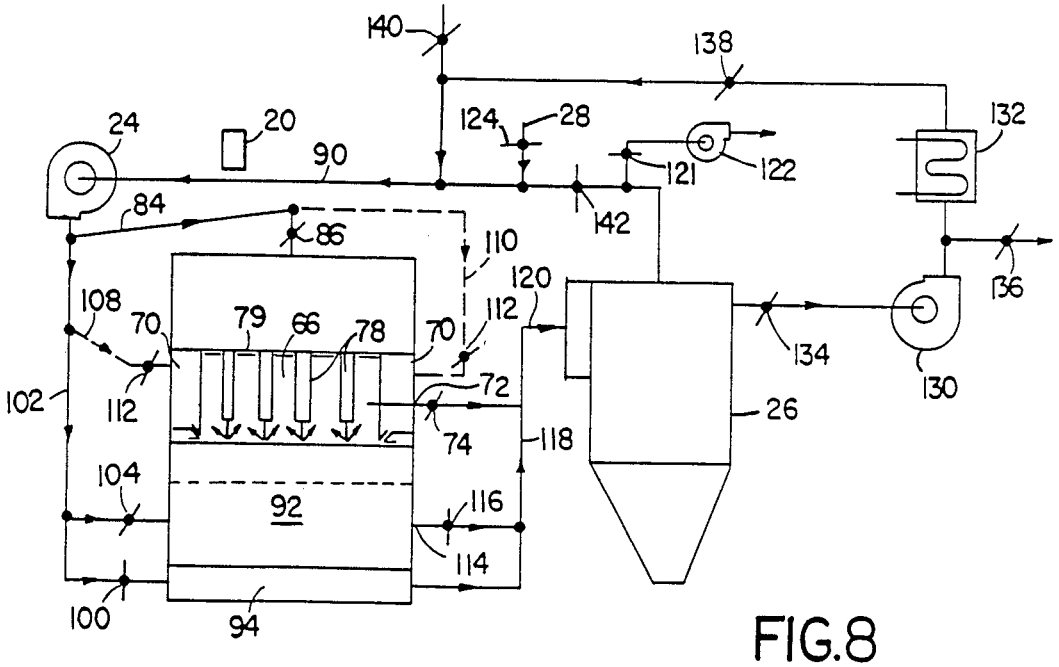

The diagrams of FIGS. 5–8 show modes of operation of a processing zone of the system shown in FIGS 1–3. The diagram of Figure 5 shows a "through the bed"-downflow mode of processing particulate material in which circulating blower 24 flows heated air through distribution plenum 80 and tubes 78 into treatment chamber 66 against baffle 79 and that air is flowed at reduced velocity through baffle 79 downwardly through the bed of particles and the transport belt 44 into lower plenum 92 for discharge through exhaust conduit 118 to cyclone separator 26; the diagram of FIG. 6 shows a "through the bed" upflow mode of operation in which heated air is flowed by blower 24 into lower plenum 92 and upwardly through transport belt 44 and into treatment zone 66 for fluidizing particles in the bed and exhaust through conduits 72 and discharge coupling 12 to cyclone separator 26; the diagram of FIG. 7 shows a fluidizing jet treatment mode in which lower plenum 92 is pressurized and downwardly flowing high velocity columns 150 of heated air from nozzles 78 impact on the pressurized conveyor 44 and are deflected outwardly and upwardly to fluidize the particulate materials on conveyor 44, the air then being exhausted through conduits 72 to cyclone separator 26; and the diagram of FIG. 8 shows a cooling mode of system operation with air exhausted from cyclone 26 being passed through a supplemental cooling circuit that includes blower fan 130, cooling coil 132 and dampers 134, 136, 138 for mixture with ambient air as controlled by damper 140 and return through inlet port 48 as controlled by damper 140 to chamber 90 for zone operation in a fluidizing jet cooling mode, the return shutoff damper 142 being closed.

With reference to FIG. 5, air in reheat chamber 90 is heated by burner 20 and circulated by blower 24. Damper valve 86 to upper plenum 80 is open; containment chamber control damper valves 112 are open; lower plenum control damper valve 104 is closed; bypass damper valve 106 is open; treatment chamber exhaust damper valves 74 are closed; and lower plenum exhaust control valve 116 is open. In an illustrative operating sequence in this through the bed downflow mode, blower 24 supplies heated air to a temperature of 250°F at 2950 SCFM to delivery conduits 84 and 102, the control dampers 86 and 106 being adjusted to a flow of 1250 SCFM into upper plenum 80 and a flow of 1640 SCFM through bypass conduit 94; and containment chamber control dampers 112 being set to supply airflow at 30 SCFM to each containment chamber 70 adjacent the edges of wire belt 44 for retaining the particulate material to be treated (dried for example) within chamber 66. In this mode of operation, perforated baffle plate 79 is positioned in offset position beneath the tubes 78 to deflect jets 150 from tubes 78 and reduce the airflow velocity impinging on the bed of particulate material on transport conveyor belt 44. The heated gases flow downwardly through the bed of particulate material for drying or other treatment interaction and then into the lower plenum 92 and are exhausted through control damper 116 and exhaust conduit 118 to cyclone 26. The exhaust from cyclone 26 is recirculated through to reheat chamber 90 with 300 SCFM being discharged through damper valve 121 to exhaust fan 122 and 158 SCFM being drawn in through ambient air inlet 28 as controlled by damper valve 124 for return past burner 20 for reheating and then to circulating blower 24.

In the mode of operation illustrated in FIG. 6, upper plenum control damper 86 is closed; dampers 104 and 106 are open and adjusted so that there is 1250 SCFM flow into lower plenum 92 and 1580 SCFM flow through bypass conduit 94; containment chamber control dampers 112 are set to pass 60 SCFM to each containment chamber 70; and treatment chamber exhaust control dampers 74 are set so that there is a total flow of about 2950 CFM to the inlet of cyclone collector 26. Dampers 121 and 124 are set to provide appropriate adjustment for inlet of ambient air to chamber 90 and discharge of excess air to exhaust fan 122. In this mode, heated air flowing upwardly through the bed of particles on conveyor 44 provides upflow fluidizing particle treatment.

In a third mode of operation illustrated in FIG. 7, upper plenum chamber damper valve 86 is adjusted to provide an air flow of 2100 SCFM into plenum 80; containment chamber damper valves 112 are adjusted to provide an air flow of 425 SCFM to each containment chamber 70; bypass duct control damper 106 is closed; lower plenum exhaust damper 116 is closed; lower plenum inlet control damper valve 104 is adjusted to pressurize lower plenum 92 sufficiently to balance the force of the air jets 150 from nozzle tubes 78 against conveyor 44; and treatment chamber exhaust control dampers 74 are open. In this mode of operation, downward flowing columns 150 of heated air from nozzle tubes 78 impact on the particles on the pressurized perforate conveyor and are deflected outwardly and upwardly to fluidize the particulate materials and then the air is exhausted upwardly from conveyor 44 through exhaust control dampers 74 to cyclone separator 26.

The mode of system operation illustrated in FIG. 8 is a jet fluidizing cooling mode employing a pressurized lower plenum 92 and single pass circuitry of air with an optional circuit that supplies refrigerated air through cooler 132, the relative amounts of cooled and ambient air supplied to chamber 90 through port 48 being controlled by dampers 138, 140.

The appropriate velocity of the fluidizing streams 150 from tubes 78 and the pressure in the lower distribution plenum 92 are in part a function of the type of particulate product to be thermally processed. For example, in the roasting of peanuts, a typical velocity of jets 150 is about 12,000 feet per minute and the pressure in lower pressure plenum 92 is about seven inches of water (at least equal to the impact pressure of the jets 150 so that the treatment air is exhausted from the treatment chamber 66 upwardly from conveyor 44 through the exhaust passages 72 in the upper portions of the sidewalls 67). Lower velocity jets 150 (for example 10,000 feet per minute) would be typically employed in the processinG of granular materials such as rice, and the pressure in the lower distribution plenum 92 would be comparably reduced to a value of about five inches of water. Still lighter products, such as cereal flakes, might be fluidized for toasting with jet velocities in the order of 6,000 to 8,000 feet per minute at a temperature of about 425°F. and a pressure in lower plenum 92 of about 2½ inches of water. In a typical cooling mode of operation, the particulate materials are lighter as water has been removed from the products, and typical products can be satisfactorily fluidized with air at ambient temperature with jet velocities of about 10,000 feet per minute and a pressure of about 6.2 inches of water in chamber 92.

The system thus enables continuous processing of particulate materials and permits a sequence of different heating and cooling processing modes to be selectively employed in a controlled environment as desired for particular materials and particular applications.

While a particular embodiment of the invention has been shown and described, various modifications will be apparent to those skilled in the art, and therefore it is not intended that the invention be limited to the disclosed embodiment or to details thereof and departures may be made therefrom within the spirit and scope of the invention:

What is claimed is:

1. A multimode system for thermal treatment of particulate material comprising structure defining a series of particle treatment zones, perforate conveyor structure for supporting the particulate material to be thermally treated disposed for movement through said series of treatment zones, each said housing structure further including structure defining a first distribution plenum disposed above said treatment zone and an array of nozzle tubes extending downwardly from said first distribution plenum into said treatment zone to flow conditioned gas through said nozzle tubes with substantial velocity into said treatment zone for thermal treatment of particulate material being transported by said conveyor structure through said treatment zone, and structure defining a second distribution plenum disposed below said treatment zone for pressurizing the region below said treatment zone and flowing conditioned gas upward through said conveyer structure for treating particulate material on said conveyer, conditioning gas circuit structure connected to said first and second distribution plenum structures, and control structures in said conditioning gas circuit structure for controlling distribution of gas through said first and second distribution plenum structures and discharge therefrom into said treatment zone to selectively provide different modes of particulate product treatment in said series of treatment zones including a treatment mode in at least one of said zones in which said conditioning gas is flowed into said second distribution plenum to maintain said second distribution plenum at a positive pressure concurrently with the flow of gas through said array of nozzle tubes in a multiplicity of downward directed jets with substantial velocity to fluidize and thermally process particulate material on said conveyor structure in said treatment zone with exhaust of gas from said treatment zone in an upward direction away from said conveyor structure.

2. The system of claim 1 wherein said perforate conveyor structure includes a wire mesh transport belt.

3. The system of claim 2 wherein the lower end of each said tube is spaced about ten centimeters from said transport belt, and said transport belt has apertures in the range of 0.1–1.0 centimeter in dimension.

4. The system of claim 1 wherein each said structure defining a particle treatment zone includes on either side a vertical wall with inclined discharge orifice structure at the base of said vertical wall that extends along the length of the treatment zone and cooperates with the upper surface of said transport belt and through which air is flowed from containment chamber structure.

5. The system of claim 1 wherein each said structure defining a particle treatment zone includes discharge port structure that is connected via control valve structure to exhaust conduit structure.

6. The system of claim 1 wherein each said structure defining a particle treatment zone includes a vertical wall on either side and said tube sheet structure is seated at the upper end of each said vertical wall and defines the upper boundary of said treatment zone, each said tube sheet structure carrying an array of said nozzle tubes that are vertically disposed and spaced less than twenty-five centimeters on center and extend over the length and width of said treatment zone.

7. The system of claim 6 and further including baffle plate structure in a particle treatment zone, said baffle plate structure being movable between a inoperative position and a velocity reducing position between the lower ends of said nozzle tubes and said conveyor structure.

8. The system of claim 1 and further including thermally insulated housing structure that includes structure defining a plurality of said particle treatment zones in said housing structure.

9. The system of claim 1 wherein said conditioning gas circuit structure includes burner means for heating conditioning gas and blower means for circulating said conditioning gas, and further including cyclone separator structure coupled in feedback loop relation between each said treatment zone and said conditioning gas circuit structure.

10. The system of claim 9 wherein said perforate conveyor structure includes a wire mesh transport belt, and each said structure defining a particle treatment zone includes on either side a vertical wall with inclined discharge orifice structure at the base of said vertical wall that extends along the length of the treatment zone and cooperates with the upper surface of said transport belt and through which air is flowed from chamber containment chamber structure, discharge port structure that is connected via control valve structure to exhaust conduit structure, and tube sheet structure seated at the upper end of each said vertical wall that defines the upper boundary of said treatment zone, each said tube sheet structure carrying an array of said nozzle tubes that are spaced less than twenty five centimeters on center and extend over the length and width of said treatment zone.

11. The system of claim 10 wherein the lower end of each said tube is spaced about ten centimeters from said transport belt, and said transport belt has apertures in the range of 0.1 –1.0 centimeter in dimension.

12. The system of claim 11 and further including thermally insulated housing structure that includes structure defining a plurality of said particle treatment zones in said housing structure.

13. The system of claim 1 and further including air blast structure and vacuum structure coupled to said second distribution plenum for removing debris from said conveyor and from said second distribution plenum.

14. The system of claim 13 and further including baffle plate structure in a particle treatment zone, said baffle plate structure being movable between a raised position and a lower velocity reducing position between the lower ends of said nozzle tubes and said conveyor structure.

15. A multimode system for thermal treatment of particulate material comprising structure defining a series of particle treatment zones, perforate conveyor structure for supporting the particulate material to be thermally treated disposed for movement through said series of treatment zones, each said housing structure further including structure defining a first distribution plenum disposed above said treatment zone and an array of nozzle tubes extending downwardly from said first distribution plenum into said treatment zone to flow conditioned gas through said nozzle tubes with substantial velocity into said treatment zone for thermal treatment of particulate material being transported by said conveyor structure through said treatment zone, and structure defining a second distribution plenum disposed below said treatment zone for pressurizing the region below said treatment zone and flowing conditioned gas upward through said conveyor structure for treating particulate material on said conveyor, conditioning gas circuit structure connected to said first and second distribution plenum structures, control structures in said conditioning gas circuit structure for controlling distribution of gas through said first and second distribution plenum structures and discharge therefrom into said treatment zone to selectively provide different modes of particulate product treatment in said series of treatment zones, and air blast structure and vacuum structure coupled to said second distribution plenum for removing debris from said conveyor and from said second distribution plenum.

16. A material treatment system comprising thermally insulated housing structure, structure in said housing structure defining a treatment zone for particulate material, perforate conveyor structure for supporting particulate material to be thermally treated defining a lower boundary of said treatment zone, sidewall structure at either side of said treatment zone including elongated orifice defining structure adjacent said conveyor structure, and containment plenum structure coupled to said orifice defining structures for flowing gas through said orifice defining structure into said treatment zone for containing particulate material within said treatment zone, structure defining a first distribution plenum above said treatment zone, an array of nozzle tubes extending downwardly from said first distribution plenum and terminating in orifices spaced from said conveyor structure and disposed to direct gas passing through said nozzle tubes in an array of gas jets downwardly towards said conveyor structure, means for exhausting gas from said treatment zone, structure defining a second distribution plenum disposed beneath said conveyor below said treatment zone, conduit means for flowing conditioned gas to said distribution and containment plenum structure and valve means in said conduit including means for controlling flow of conditioning gas to said plenum structures such that said system has a first mode of operation in which conditioning gas is flowed downwardly from said upper distribution plenum through said treatment zone and said perforate conveyor structure into said second distribution plenum for exhaust therefrom; a second mode of operation in which conditioning gas is flowed from said second distribution plenum upwardly through said perforate conveyor structure into said treatment zone and exhaust therefrom; and a third treatment mode in which said conditioning gas is flowed into said second distribution plenum to maintain said second distribution plenum at a positive pressure concurrently with the flow of gas through said array of nozzle tubes in a multiplicity of downward directed jets with substantial velocity to fluidize and thermally process particulate material on said conveyor structure in said treatment zone with exhaust of gas from said treatment zone in an upward direction away from said conveyor structure.

17. The system of claim 16 wherein said perforate conveyor structure includes a wire mesh transport belt.

18. The system of claim 17 wherein said structure defining a particle treatment zone includes discharge port structure that is connected via control valve structure to exhaust conduit structure.

19. The system of claim 18 wherein said structure defining said treatment zone includes tube sheet structure that is seated at the upper ends of said vertical wall and defines the upper boundary of said treatment zone, each said tube sheet structure carrying an array of said nozzle tubes that are spaced less than twenty five centimeters on center and extend over the length and width of said treatment zone.

20. The system of claim 19 and further including baffle plate structure in a particle treatment zone, said baffle plate structure being movable between a raised position and a lower pressure reducing position between the lower ends of said nozzle tubes and said conveyor structure.

21. The system of claim 19 and further including air blast structure and vacuum structure coupled to said second distribution plenum for removing debris from said conveyor and from said second distribution plenum.

22. The system of claim 19 and further including burner means for heating conditioning gas, blower means for circulating said conditioning gas, and cyclone separator structure coupled in feedback loop relation between said treatment zone and said blower means.

23. The system of claim 22 wherein the lower end of each said tube is spaced about ten centimeters from said transport belt, and said transport belt has apertures in the range of 0.1 –1.0 centimeter in dimension.

24. The system of claim 23 and further including thermally insulated housing structure that includes structure defining a plurality of said particle treatment zones in said housing.

25. The system of claim 24 wherein said structure defining a particle treatment zone includes on either side a vertical wall with inclined discharge orifice structure at the base of said vertical wall that extends along the length of the treatment zone and cooperates with the upper surface of said transport belt and through which air is flowed from containment chamber structure.

* * * * *